United States Patent [19]

Chen

[11] Patent Number: 4,651,448

[45] Date of Patent: Mar. 24, 1987

[54] GOLF SPIKE ASSEMBLY

[75] Inventor: York Chen, San Mateo, Calif.

[73] Assignee: Contax Sports, Inc., Burlingame, Calif.

[21] Appl. No.: 868,647

[22] Filed: May 29, 1986

Related U.S. Application Data

[62] Division of Ser. No. 683,709, Dec. 19, 1984.

[51] Int. Cl.[4] ..... A43B 5/00; A43B 15/00

[52] U.S. Cl. ..... 36/134; 36/127; 36/67 D

[58] Field of Search ..... 36/67 R, 67 A, 67 D, 36/134, 127

[56] References Cited

U.S. PATENT DOCUMENTS

| | | | |
|---|---|---|---|
| 2,309,783 | 2/1943 | Park | 36/67 D |
| 2,481,370 | 9/1949 | Trusty | 36/67 D |
| 2,787,843 | 4/1957 | Phillips | 36/67 D |
| 2,918,733 | 12/1959 | Anderson | 36/67 D |
| 3,010,229 | 11/1961 | Smitzer | 36/134 |
| 3,133,363 | 5/1964 | Phillips | 36/67 D |
| 3,204,347 | 9/1965 | Snow | 36/67 D |
| 3,328,901 | 7/1967 | Strickland | 36/67 D |
| 3,685,175 | 8/1972 | Granger, Jr. | 36/67 R |
| 3,715,817 | 2/1973 | White et al. | 36/67 D |
| 3,977,097 | 8/1976 | Ueda | 36/67 D |
| 4,043,372 | 12/1977 | MacNeil | 36/127 |
| 4,146,979 | 4/1979 | Fabbrie | 36/127 |
| 4,454,664 | 6/1984 | MacNeil | 36/67 D |
| 4,466,205 | 8/1984 | Corbari | 36/134 |

FOREIGN PATENT DOCUMENTS

| | | | |
|---|---|---|---|
| 223894 | 3/1958 | Australia | 36/127 |
| 885669 | 8/1953 | Fed. Rep. of Germany | 36/67 A |
| 2540426 | 3/1977 | Fed. Rep. of Germany | 36/67 R |
| 176911 | 9/1935 | Switzerland | 36/67 A |
| 563738 | 7/1975 | Switzerland | 36/127 |
| 2028102 | 3/1980 | United Kingdom | 36/67 D |
| 2088196 | 6/1982 | United Kingdom | 36/134 |
| 2115683 | 9/1983 | United Kingdom | 36/134 |

*Primary Examiner*—Werner H. Schroeder
*Assistant Examiner*—Steven N. Meyers
*Attorney, Agent, or Firm*—Ciotti & Murashige

[57] ABSTRACT

An improved receptacle and spike assembly for athletic shoes is described. The spike assembly contains four fastening holes, and supports a spike and a connector. The improved receptacle is secured to a plate by embedding injectable material into cavities surrounding a suitable connector.

5 Claims, 7 Drawing Figures

GOLF SPIKE ASSEMBLY

This application is a divisional of U.S. application Ser. No. 683,709 filed Dec. 19, 1984.

BACKGROUND

This invention relates to the field of athletic shoe manufacture. More specifically, it relates to an improved assembly for providing spiked soles on athletic shoes, particularly on shoes designed for golfers.

It has long been understood that it is desirable to provide stability to the wearer of athletic shoes designed for use in golf. Because the motion of the player in execution of drives in the course of this game results in instability of footing, footwear has been provided which has a means to secure the player to the ground during this maneuver. Ordinarily, this is accomplished by providing, in the soles of shoes designed for golfers, a pattern of metal spikes which become embedded in the turf, and thus provide the player with a firm footing.

Traditionally, the spikes are secured to a rubber or synthetic shoe sole by means of a flat metal plate bearing a series of pronged fasteners around its periphery, and a tubular threaded female connector protruding from its center toward the bottom of the shoe. The spike itself is contiguous with a threaded male connector, and is provided with a metal flange containing two holes which permit insertion of a two-pronged key. The two-pronged key, then, is used to turn the flange containing the spike and male connector so as to secure the spike assembly to the receptacle assembly.

Because of the required number of spikes, the metal flange portions add considerable weight to the shoe. Therefore, improvements have been made in the spike assembly by using only a metal frame contiguous with the connector and spike, and embedding the metal frame into a plastic or nylon flange. In this version of the spike assembly, the lighter weight of the plastic or nylon results in a lighter shoe. One design of this modification utilizes a plastic thread on the male connector, as well, but this has proved clearly unsatisfactory due to inadequate strength. Another design provides a metal male screw thread, and stabilizes the spike assembly by a series of three fan blade projections from the connector/spike. This design provides two keyholes for tightening the spike onto the receptacle, thus requiring large arc motions in tightening it down.

None of the foregoing designs is completely satisfactory. The pronged receptacle relies on securing means which, because they bear directly against the surrounding material, often cause tearing and weakening of the soles and become loose. The metal flanged spike is unduly heavy; the plastic threaded connector, because of the weakness of the material, tends to strip; the tri-bladed assembly has an uneven weight distribution with respect to the two keyholes provided to secure the spike. The present invention overcomes these deficiencies.

SUMMARY OF THE INVENTION

The invention provides both an improved receptacle for the golf spike assembly, and an improved golf spike assembly design. The receptacle is secured to the outer sole layer by injection of molding into cavities of the receptacle, thus permitting the receptacle to be secured to an outer sole plate without the shear forces associated with the pronged receptacle. The golf spike assembly is light weight, is easily secured, and is highly reliable.

Thus, in one aspect, the invention is directed to an improved receptacle for a golf spike, which comprises an annular, slightly concave dish, from which is extended, at the center, a tubular, threaded, female connector. The connector is disposed on the concave side of the dish, and will project outward from the sole of the shoe. Surrounding the connector, is a series of circular perferations in the dish which can accommodate injection molded plastic or nylon. The mold-receiving cavities are covered, on the concave face of the dish, with a cap or "stopper" to prevent excess material from being extruded from the outer face of the dish. These stoppers are, preferably, inegral with the base of the dish.

In another aspect, the invention is directed to a golf spike assembly, which comprises a metal frame support having a series of perforations at the periphery and, in the center, projecting from one face, the steel spike and from the other face a threaded male connector. This frame with its projections is embedded on a concave nylon base which contains four equi-spaced keyholes for use in tightening, which are in communication with the peripheral slots in the frame. The concave face of the nylon base is toward the connector, and the spike, thus, projects from the convex side of the base.

A BRIEF DESCRIPTION OF THE DRAWINGS

FIG. 1A represents the view looking from left to right in FIG. 1B.

DETAILED DESCRIPTION OF A PREFERRED EMBODIMENT

Figure 1A:
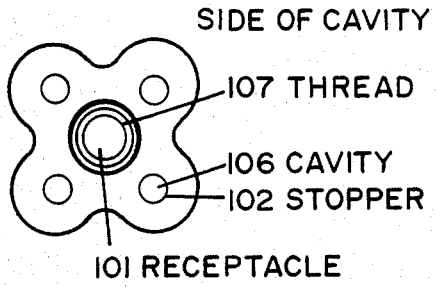
FIGS. 1A and 1B are facing view and side view, respectively, of the receptacle.

The invention can best be understood by reference to a specific preferred embodiment, as illustrated in the drawings herein. This description, however, is intended to be illustrative and not limiting. Any design within the scope of the appended claims, although not specifically shown in the drawings, is to be considered a part of the invention.

Figure 1B:
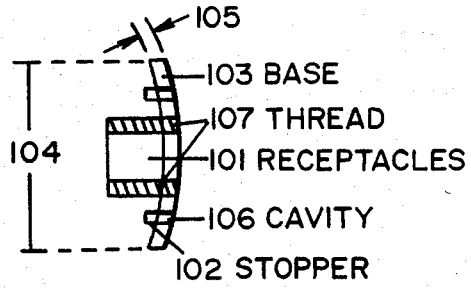

The improved receptacle of the invention is shown in FIGS. 1A and 1B. FIG. 1A shows a facing view of the metal dish which contains at its center a protruding threaded connector, 101. The connector is surrounded by a series of cavities spaced at positions equidistant from each other and from the center of the dish, as shown at 106. The dish is cut in an irregular pattern to minimize weight, but other overall shapes, such, as a circular dish, are consistent with the invention.

The features of the receptacle are shown in FIG. 1B, which is a side view of the receptacle. As shown, the dish itself, 103, is slightly concave. The dish is approximately 2–3 cm in its longest dimension, 104, and is approximately 1–3 mm thick, as shown at 105. The dimension 104 need not be completely uniform across the face of the dish. The cavities, 106, are shown capped with stoppers, 102. The cavities extend through the thickness of the dish, and the stoppers are contiguous thereto. These cavities are most conveniently formed by stamping the metal dish so that the stoppers are derived from the same blank as the remainder of the base. Still referring to FIG. 1B, the connector, 101, is threaded internally, 107, so as to provide a receptacle connector with the spike assembly.

Figure 2A:
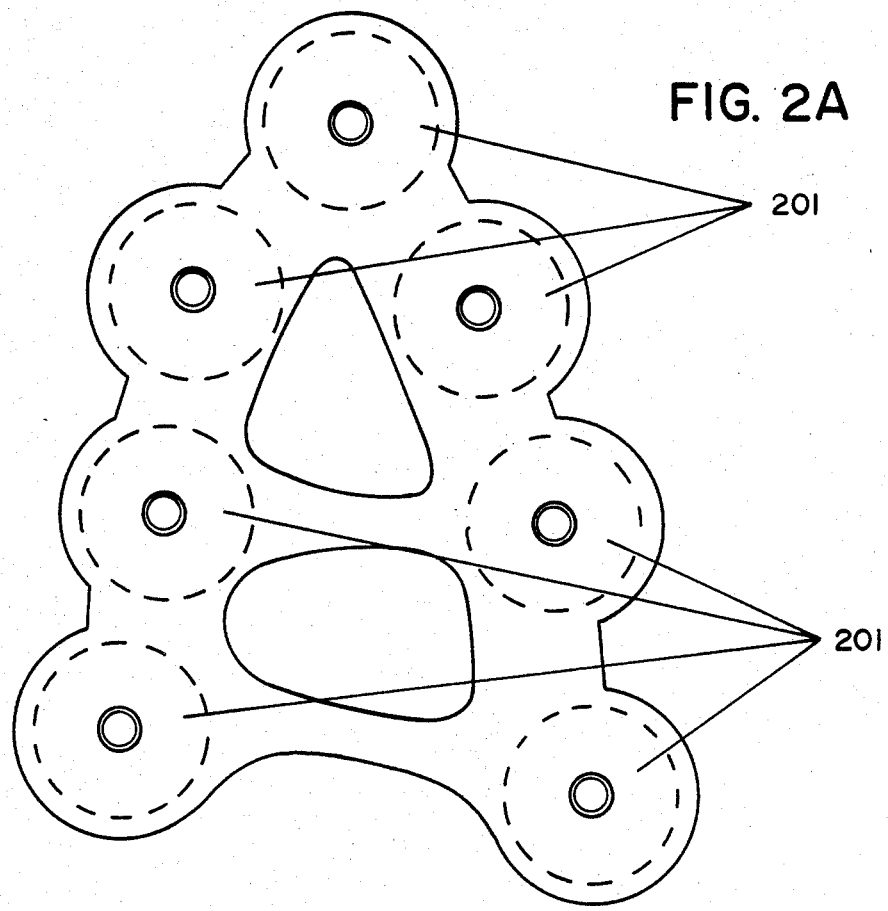
FIGS. 2A and 2B are respectively, facing views of a front and heel plate arrangement suitable for containing the receptacles.
Figure 2B:
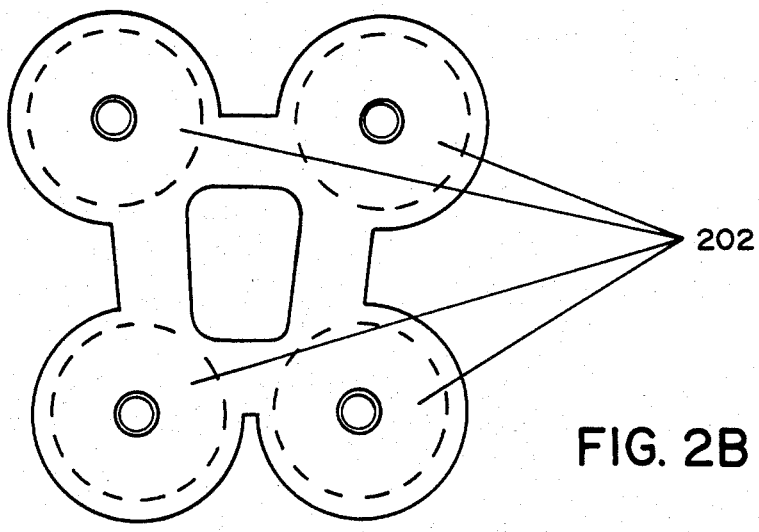

The receptacles shown in FIG. 1 are mounted on the shoe by means of a nylon or other synthetic sole plate, as shown in FIGS. 2A and 2B. FIG. 2A shows a suitable design for the front portion of the sole, designed to bear seven receptacles at positions 201. The heel plate in this design is able to accommodate four receptacles at positions 202 as shown in FIG. 2B. The receptacles are secured to the plates by injection molding of the plate material, which flows around the receptacle and into the capped cavities, 106. The molded projections thus maintain the integrity of the assembly, and because they do not rely on puncturing the plate, as do traditional receptacles, the tendency of the plate to tear is less. The diameter of the cavities designed to receive the injection mold is approximately 2–5 mm.

Figure 3A:
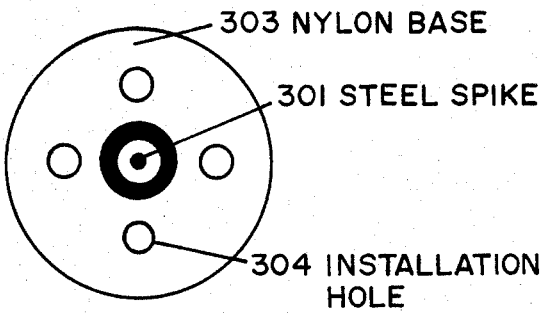
FIGS. 3A and 3B are, respectively, a facing and side view of the golf spike assembly of the invention.
Figure 3B:
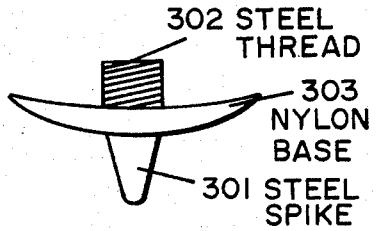
Figure 4:
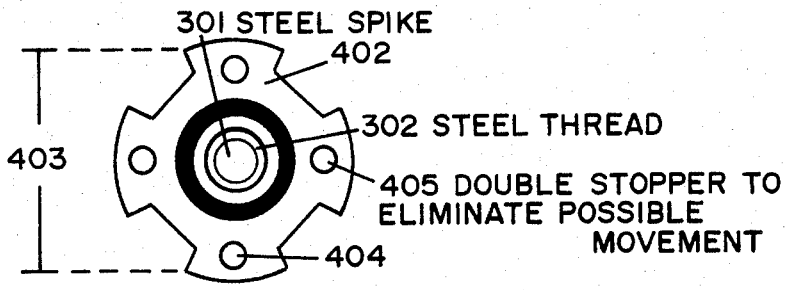
FIG. 4 is a facing view of the metal frame to be embedded in the spike assembly.

FIGS. 3A and 3B show the front and side view of the finished spike assembly; FIG. 4 shows the inner frame, which stabilizes it. Referring to FIG. 4, 401 shows the spike projecting from the center of the frame toward the viewer; not shown, but in the same position away from the viewer on the other side of the frame is the threaded male connector. The frame itself, 402, is approximately 2–3 cm in diameter, as shown at 403, and is approximately 1–4 mm in thickness (dimension not shown). The periphery of the frame is provided with a series of 4 perforations, 404, which are shown at equal distances from each other and from the center, and which are designed to accommodate the turnkey used to tighten the spike assembly. In addition, the frame perforations contain perpendicular extensions at 405 to prevent movement of the frame within the assembly. These are not visible in the figure.

Position 301 in FIG. 4 corresponds to position 301 in FIGS. 3A and 3B. 3A and 3B show the frame embedded in the outer nylon dish, which provides the appropriate surface area and finish, but with less increase in weight than a metal analog. FIG. 3B shows a side view where the spike, 301, is indicated protruding from the convex face of a curved nylon outer dish; and the threaded connector projects from the concave face of this dish. The dimensions of the threaded connector, 302, are matched to those of the receptacle, shown in FIG. 1B. Typically, the connector 302 has an outer diameter of 3–6 mm, and the inner diameter of the receptacle connector shown in 1B at 107, has an inner diameter corresponding to this dimension. Both connectors are about 0.4–1 cm long. The curved nylon base, 303, separates the connector from the spike, as shown in FIG. 3B.

FIG. 3A shows the arrangements of the installation holes, 304, in the nylon base. These are also arranged radially from the center, and at equal distances. When the frame of FIG. 4 is embedded in the finished assembly of FIG. 3A, the installation holes, 304, are in communication with the perforations, 404, in the frame. Thus, the entire assembly can be tightened onto the receptacle by inserting a key into the installation holes. As there are four such holes, a double-pronged key can be turned through a very shallow arc in effecting the fastening of the assembly. Further, as the perforations are provided with perpendicular edges, 405, the frame is precluded from moving within the nylon outer dish.

I claim:

1. An improved receptacle for a golf spike assembly, which comprises:

an annular, slightly concave, dish;

a tubular, threaded, female connector disposed in the concave face of said dish and contiguous with the center thereof; and a series of cylindrical cavities disposed peripherally to the connector, extending through the thickness of the dish, and each capped by a stopper on the concave face of the dish.

2. The receptacle of claim 1 wherein the dish has a diameter of about 2–3 cm.

3. The receptacle of claim 1 having aforesaid cylindrical cavities disposed equidistant from the threaded receptacle axis.

4. The receptacle of claim 1 embedded in a nylon plate.

5. The receptacle of claim 4 secured to the sole of an athletic shoe.

* * * * *